US006489924B2

(12) United States Patent
Pretorius et al.

(10) Patent No.: US 6,489,924 B2
(45) Date of Patent: Dec. 3, 2002

(54) ANTENNA AND METHOD OF MAKING SUCH ANTENNA AND COMPONENT PARTS THEREOF

(75) Inventors: Johannes Arnoldus Pretorius, Cape Town (ZA); William Ian George, Cape Town (ZA); Marius Du Plessis, Cape Town (ZA)

(73) Assignee: Omnipless (Proprietary) Limited, Hout Bay (ZA)

( * ) Notice: Subject to any disclaimer, the term of this patent is extended or adjusted under 35 U.S.C. 154(b) by 0 days.

(21) Appl. No.: 09/826,753

(22) Filed: Apr. 5, 2001

(65) Prior Publication Data

US 2001/0028325 A1 Oct. 11, 2001

(30) Foreign Application Priority Data

Apr. 7, 2000 (ZA) ..... 2000/1766

(51) Int. Cl.[7] ..... H01Q 1/38
(52) U.S. Cl. ..... 343/700 MS; 174/138 A
(58) Field of Search ..... 343/700 MS, 846; 340/572.1, 572.8; 235/487, 492; 174/138 A

(56) References Cited

U.S. PATENT DOCUMENTS

| | | | | |
|---|---|---|---|---|
| 4,546,357 A | | 10/1985 | Laughon et al. | 343/702 |
| 5,160,936 A | * | 11/1992 | Braun et al. | 343/725 |
| 5,829,121 A | | 11/1998 | Shoemaker et al. | 29/600 |
| 5,844,523 A | * | 12/1998 | Brennan et al. | 343/700 MS |
| 6,147,604 A | * | 11/2000 | Wiklof et al. | 340/572.1 |

* cited by examiner

*Primary Examiner*—Don Wong
*Assistant Examiner*—James Clinger
(74) *Attorney, Agent, or Firm*—Wood, Herron & Evans, L.L.P.

(57) ABSTRACT

An antenna comprises a conductive foil layer (16) which forms a ground plane, a conductive foil element (20) spaced from the ground plane, and a dielectric substrate (14) separating the foil element from the ground plane, the dielectric substrate being of an extruded plastics material having a cellular configuration in cross-section. More particularly, the dielectric substrate comprises one or more superimposed substrate sheets of extruded plastics material, with the or each substrate sheet comprising a pair of spaced, parallel skins (38) and webs (40) extending between and separating the skins. A method of applying the foil element to the dielectric substrate and of making the antenna and various component parts thereof are also disclosed.

13 Claims, 4 Drawing Sheets

ANTENNA AND METHOD OF MAKING SUCH ANTENNA AND COMPONENT PARTS THEREOF

BACKGROUND TO THE INVENTION

This invention relates to an antenna and to a method of making such antenna and component parts thereof.

Flat panel antennas generally have one or more radiator elements or patches and a feed circuit for the patches, the patches and the feed circuit being of thin flat conductive material and being separated from a conductive ground plane by means of one or more layers of a dielectric substrate. The most common method of making such antennas involves the use of photolithographic or etching techniques on thin copper sheets laminated on microwave substrate materials. The substrate materials are relatively high loss materials and are expensive. Styrofoam has also been used as a dielectric material, but this suffers from moisture retention which is detrimental to the performance of the antenna.

It is an object of the Invention to provide an antenna construction which makes use of low cost and, in the case of the dielectric material, low loss materials, which can be die-cut with sufficient accuracy to enable repeatable high volume assembly.

SUMMARY OF THE INVENTION

According to the invention there is provided an antenna which comprises means forming a ground plane, a conductive foil element spaced from the ground plane, and a dielectric substrate separating the conductive foil element from the ground plane, the substrate being of an extruded plastics material having a cellular configuration in cross-section.

Thus, the substrate may be of the kind of extruded plastics material that comprises a pair of spaced, parallel skins and webs extending between and separating the skins. Such material is also referred to generically as "corrugated plastic" because of its resemblance to corrugated cardboard. It is commonly used in the packaging and signage industries. One such type of material is available commercially in South Africa as "Coruplas", which is an extruded polypropylene material.

The substrate may comprise two or more superimposed sheets of extruded plastics material, each said sheet having a pair of spaced, parallel skins and webs extending between and separating the skins.

Where the antenna includes one or more radiator elements, the conductive foil element may be configured to form a feed circuit for the radiator element or elements.

The feed circuit may be a microstrip feed circuit, or it may be a stripline feed circuit.

In another form of the invention the conductive foil element may be configured to form said radiator element or elements.

The dielectric substrate may comprise a pair of superimposed lower and upper sheets of dielectric material, each said sheet being of an extruded plastics material having a cellular configuration in cross-section, and the upper sheet having an edge which is within the periphery of the lower sheet, the conductive element being a one-piece element having a first portion which is supported by the upper face of the lower sheet, a second portion which extends up said edge to the upper face of the upper sheet, and a third portion which is supported by the upper face of the upper sheet.

In yet another form of the invention the conductive element may be a one-piece element which is configured to form said radiator element or elements and a feed circuit for the radiator element or elements.

In this event the dielectric substrate may comprise a pair of superimposed lower and upper sheets of dielectric material, each said sheet being of an extruded plastics material having a cellular configuration in cross-section, and the upper sheet having an edge which is within the periphery of the lower sheet, wherein that part of said conductive element which forms the feed circuit has a first portion which is supported by the upper face of the lower sheet and a second portion which extends up said edge to the upper face of the upper sheet, and wherein that part of said conductive element which forms the radiator element or elements is supported by the upper face of the upper sheet.

The conductive foil element may comprise a die-cut conductive foil element.

Further according to the invention there is provided a method of making an antenna having a dielectric substrate and a conductive foil element on the substrate, the foil element having a predetermined outline, which method comprises:

providing the substrate as a sheet of extruded plastics material having a cellular configuration in cross-section;

providing a sheet of conductive foil and die-cutting the foil sheet along said outline, in such a manner that bridge portions of foil remain between that part of the foil sheet which is inside the outline and that part of the foil sheet which is outside the outline;

applying the foil sheet, after it has been die-cut, to the substrate sheet, there being an adhesive between that part of the foil sheet which is inside the outline and the substrate sheet, so that that part of the foil sheet which is inside the outline becomes attached to the substrate sheets by means of the adhesive; and thereafter removing that part of the foil sheet which is outside the outline by severing the bridge portions.

The adhesive may, prior to applying the foil sheet to the substrate sheet, be applied to the substrate sheet across a selected area corresponding roughly to the area defined by said outline.

The adhesive may be applied to the substrate sheet by means of a silk-screening process.

A protective peel-off sheet may be applied to the dielectric sheet after the adhesive has been applied to the dielectric sheet, to cover the adhesive, and the peel-off sheet subsequently, prior to applying said foil sheet, removed.

Still further according to the invention there is provided a method of making a component part of an antenna, which component part comprises a dielectric substrate and a layer of conductive foil adhered to the dielectric substrate, wherein the assembly of substrate and conductive foil layer is die-cut by means of a die-cutting apparatus having a base and a head with die-cutting blades, the head and the base moving towards one another during a die-cutting operation, and wherein said assembly is placed on the base with the side of the conductive foil layer being adjacent the base, whereby the die-cutting blades penetrate the assembly from the side of the dielectric sheet and move towards the side of the conductive foil layer.

The invention will now be described in more detail, by way of example, with reference to the accompanying drawings.

DETAILED DESCRIPTION OF PREFERRED EMBODIMENTS

Figure 1:
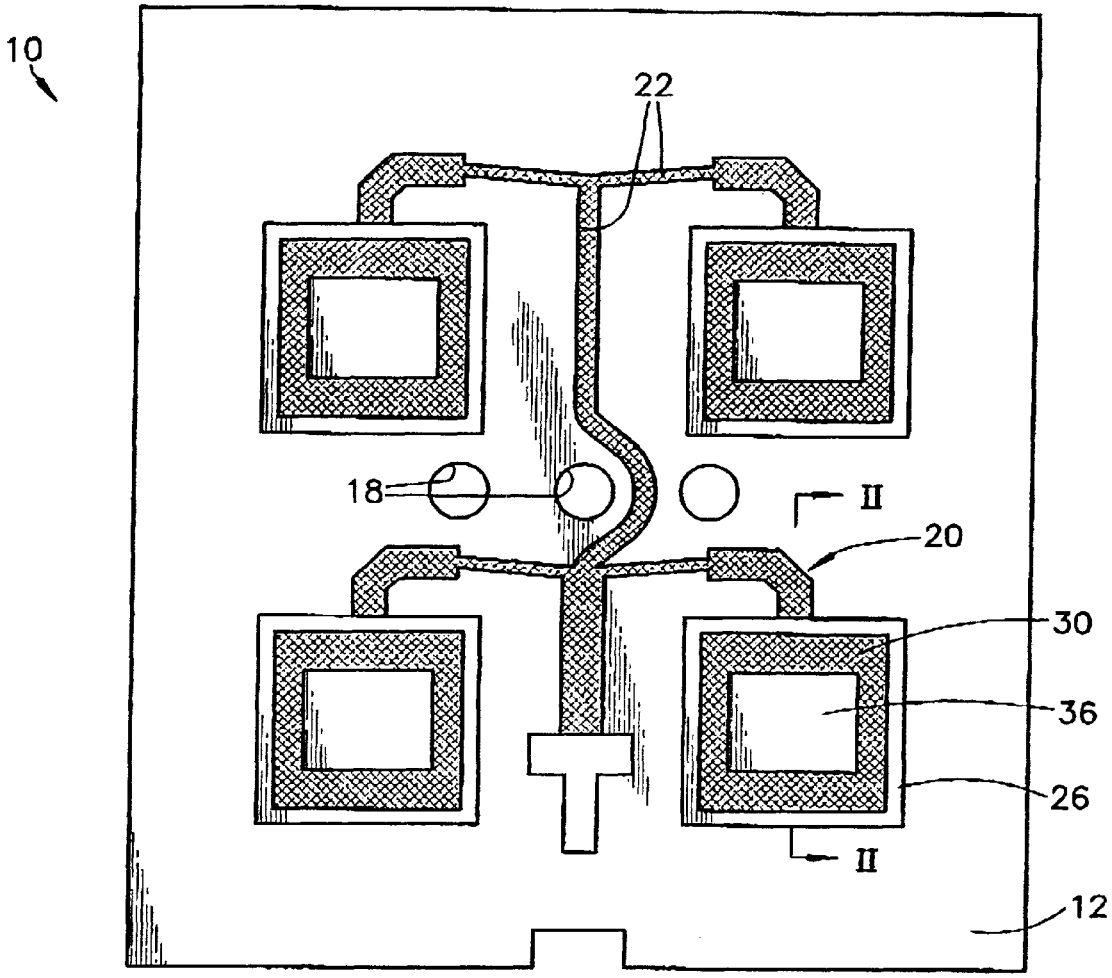
FIG. 1 is a plan view of one form of planar or flat panel array antenna in accordance with the invention.
Figure 2:
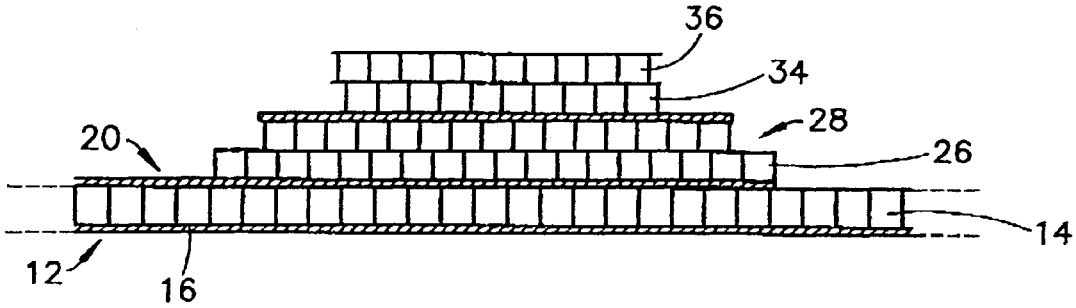
FIG. 2 is a diagrammatic section on II—II in FIG. 1, showing the component parts in their assembled condition.
Figure 3:
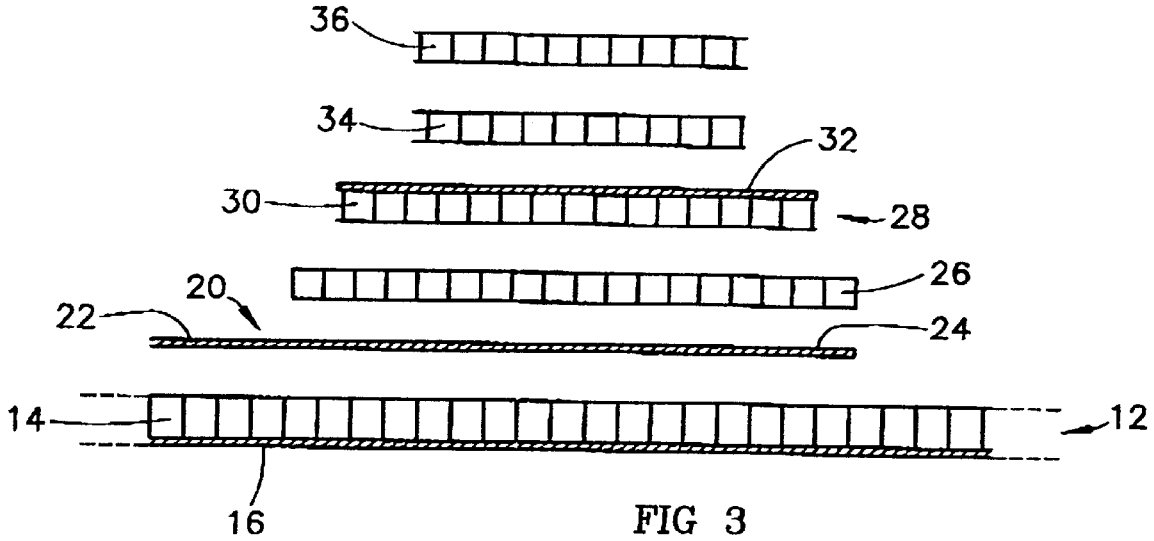
FIG. 3 is a section similar to FIG. 2, but showing the component parts in an exploded condition.

Referring first to FIGS. 1 to 3, reference numeral 10 generally indicates a flat panel array antenna. The antenna that is illustrated will normally be enclosed between two flat radome shells which are not shown in the drawings.

The antenna comprises a base panel 12 which in turn comprises a substrate sheet 14 of corrugated plastic which has a layer of conductive foil 16 adhered to the lower surface thereof, to form a ground plane. The substrate sheet 14 has the conductive foil 16 pre-applied thereto and is die-cut to the required shape. The die-cutting may, for example, include forming holes 18 in the base panel, which holes can be used for alignment purposes during assembly of the antenna.

Figure 9:
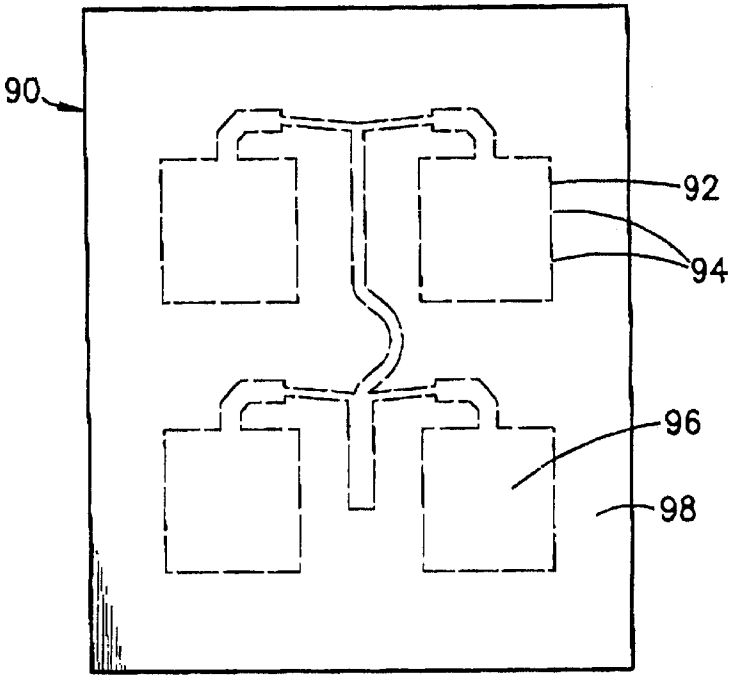
FIGS. 8 to 10 illustrate a method according to which certain component parts of the antenna are made.

On the upper surface of the base panel 12 there is a conductive foil element 20 which forms a feed circuit 22 and radiator elements or patches 24 (see FIGS. 3 and 9). A sheet of conductive foil may initially, during manufacture, extend across the entire face of the base panel 12, the foil sheet being die-cut to form it with the feed circuit 22 and patches 24, the foil material of the feed circuit and the patches being connected to the remainder of the foil sheet by narrow bridge portions. These bridge portions may, for example, be formed by nicks in the die-cutter that is used to perform the die-cutting operation. The substrate sheet 14 may have an adhesive pre-applied thereto roughly according to the pattern of the feed circuit 22 and patches 24. This may, for example, be done by means of a silk-screening process. Prior to assembly of the antenna the silk-screened adhesive may be covered by a peel-off strip. To secure the conductive foil element 20 to the substrate sheet 14 during assembly of the antenna, the peel-off strip is first removed and the die-cut foil sheet then applied to the upper surface of the substrate sheet. This causes the foil sheet to adhere to the substrate sheet only in those areas where adhesive has been applied, which will be in the region of the feed circuit 22 and the patches 24. The unwanted part of the foil sheet can then be removed, by severing the bridge portions, leaving the feed circuit 22 and patches 24 behind on the substrate sheet.

The antenna 10 will include a suitable connector (not shown) for connecting the feed circuit 22 to an external feed.

The antenna illustrated in FIGS. 1 to 3 has a stacked patch configuration. On each of the patches 24 there is a spacer 26 which can be in the form a plain, rectangular piece of corrugated plastic. This is adhesively secured to the upper surface of the patch 24. On top of this there is a further element 28 which comprises a rectangular piece of corrugated plastic 30 having a layer of conductive foil 32 adhered to the upper surface thereof. The conductive foil 32 is pre-applied to the corrugated plastic, and the element is produced by die-cutting. Die-cutting is preferably performed by causing the die-cutting blades first to pass through the corrugated plastic material before cutting the conductive foil 32. By doing this a clean cut of the conductive foil is achieved, to the precise dimensions of the die-cutter. If the material is cut from the other direction, i.e. with the die-cutting blades first passing through the conductive foil, there is a tendency for the foil to fold about the edges of the element, which is not desired. The conductive foil 32 constitutes the upper patch of the stacked patch configuration.

On top of the element 28 there are two further spacer elements 34 and 36, these each being plain rectangular pieces of corrugated plastic which are conveniently produced by die-cutting. The spacer elements 34, 36 serve to separate the conductive foil 32 of the stacked patch from the inside surface of the upper radome shell (not shown).

In an alternative stacked patch configuration (not shown), the upper patch can be applied to the inside surface of the upper radome shell.

The components 26, 28, 34, and 36 may each have an adhesive pre-applied thereto, the adhesive being covered by a peel-off strip. The peel-off strip is then removed prior to assembly of the antenna.

It will be understood that there can be a single or any number of layers of spacer material above and below the conductive foil 32, depending on the design and availability of specific material thicknesses. For example, the layer 26 could be omitted, as can be the layers 34 and/or 36.

For purposes of illustration the thicknesses of the foil layers 16, 20, and 32 has been greatly exaggerated in FIGS. 2 and 3 of the drawings.

Figure 4:
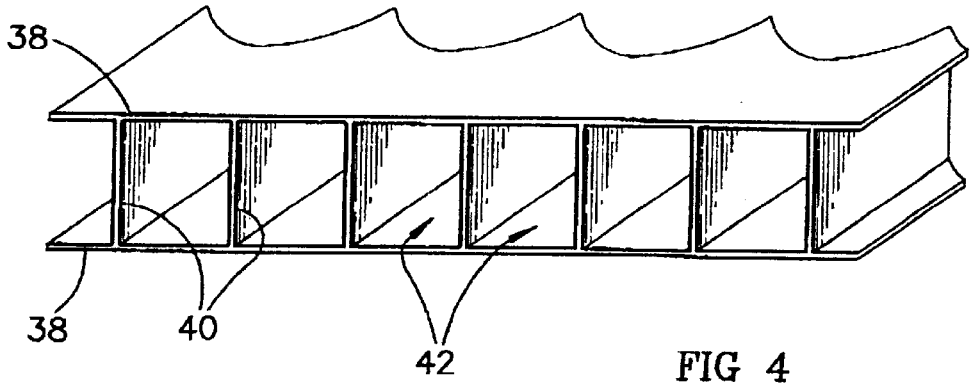
FIG. 4 is a detail section of the substrate material that is used in the antenna construction.

Referring now to FIG. 4, the corrugated plastic, which is produced by extrusion, comprises upper and lower skins 38 and webs 40 which extend between and separate the skins. Between the webs 40 there are voids 42 which extend along the length of the corrugated plastic, thereby providing the material with a cellular configuration In cross-section.

It has been found that corrugated plastic has several properties that make it exceptionally suitable for the use in a flat panel antenna. The relative dielectric constant of the material is close to 1,1, and it has a very low loss tangent. The structure of the material provides a flat surface which is particularly suitable for the application of adhesives or other laminating substances or materials. It is a low cost, mass produced, commercial product, which Is available in various discrete thicknesses, with good manufacturing tolerances. The material can be die-cut with sufficient accuracy to enable repeatable high volume assembly.

Figure 5:
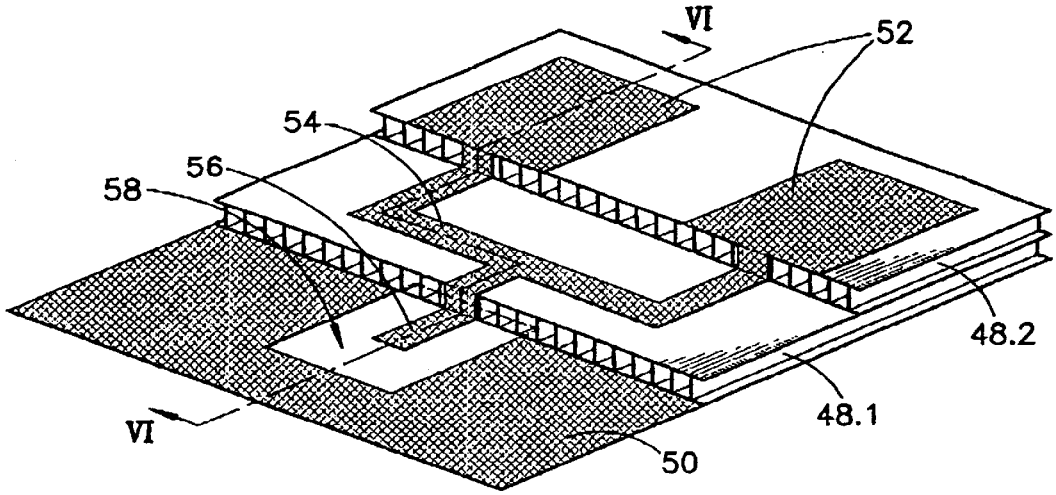
FIG. 5 is an oblique view of another form of flat panel array antenna in accordance with the invention.
Figure 6:
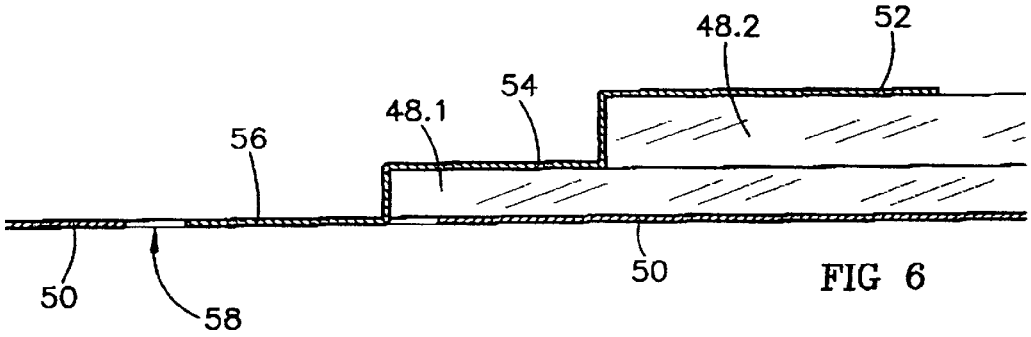
FIG. 6 is a diagrammatic section on VI—VI in FIG. 5.

Referring now to FIGS. 5 and 6, there is shown an antenna construction which has two superimposed substrate sheets 48.1 and 48.2 of corrugated plastic. The lower substrate sheet 48.1 carries a conductive foil layer 50 on the underside thereof, to form a ground plane. Patches 52 of conductive foil are applied to the upper surface of the upper substrate sheet 48.2, and a feed circuit 54 of the microstrip type and leading to the patches is applied to the upper surface of the lower substrate sheet 48.1, in a region thereof which is not covered by the upper substrate sheet 48.2. The patches 52 can therefore be at a higher level above the ground plane formed by the foil layer 50 than the feed circuit 54, providing the patches with an increased resonant bandwidth and higher radiation efficiency. Also, with the feed circuit 54 being close to the ground plane formed by the foil layer 50, feed radiation is minimized and the efficiency therefore improved. If desired, different parts of the feed circuit can be at different heights above the ground plane, to allow for impedance transformation. Also, a part 56 of the feed circuit can be at the level of the ground plane, to allow for coupling of the feed circuit to external circuits through a window 58 in the ground plane. The ability to place different conductive parts of the antenna on different layers is due to the use of flexible foil components which can be formed or folded as required, and are therefore not confined to specific layers.

Figure 7:
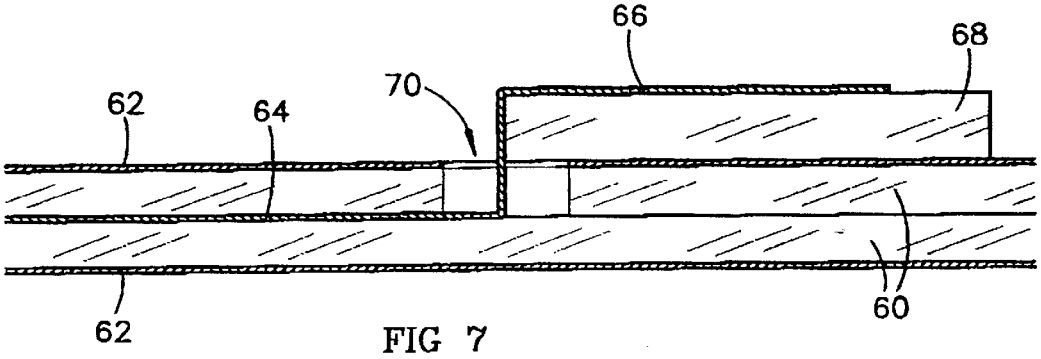
FIG. 7 is a section similar to FIG. 6, but showing a stripline feed structure.

Whereas the feed circuits illustrated in FIGS. 1 to 6 are of the microstrip type, they could also be of the stripline type, as illustrated in FIG. 7. In this construction there are two substrate sheets 60 which are adhered to one another face to face, each of them carrying a layer of conductive foil 62 to form upper and lower ground planes. A feed line 64 is sandwiched between the two substrate sheets. The antenna of FIG. 7 further has a patch 66 which is spaced from the upper ground plane formed by the foil layer 62 by means of a spacer 68. The feed line 64 is threaded through an opening in the upper substrate sheet (and the associated conductive foil layer 62) at a feed point 70. The feed line does not have to be attached physically to the patch, but could be coupled capacitively to the patch by the feed line and the patch having overlapping sections. The substrate sheets 60 and the spacer 68 are each of corrugated plastic as hereinbefore described.

As in FIGS. 2 and 3, the thicknesses of the foil layers 50, and 52, 54, 56 have been greatly exaggerated in FIGS. 6 and 7 of the drawings.

Figure 8:
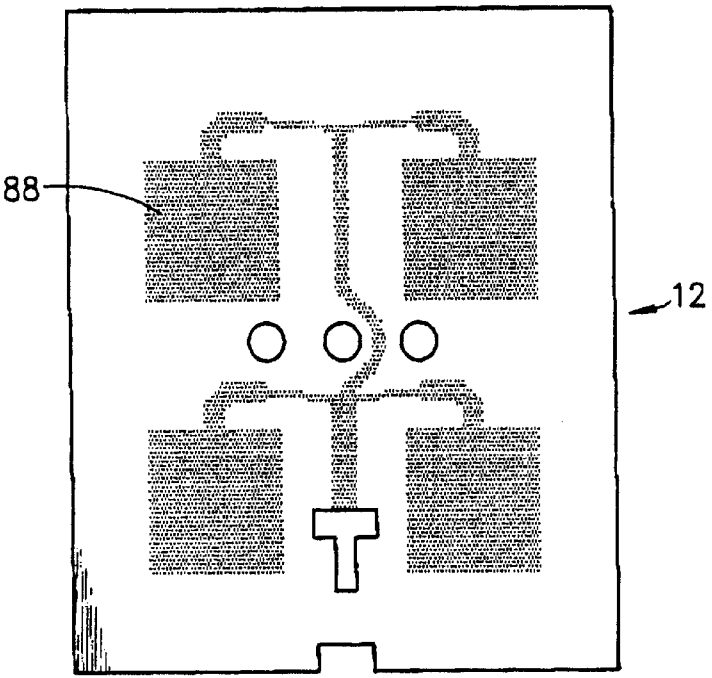
Figure 10:
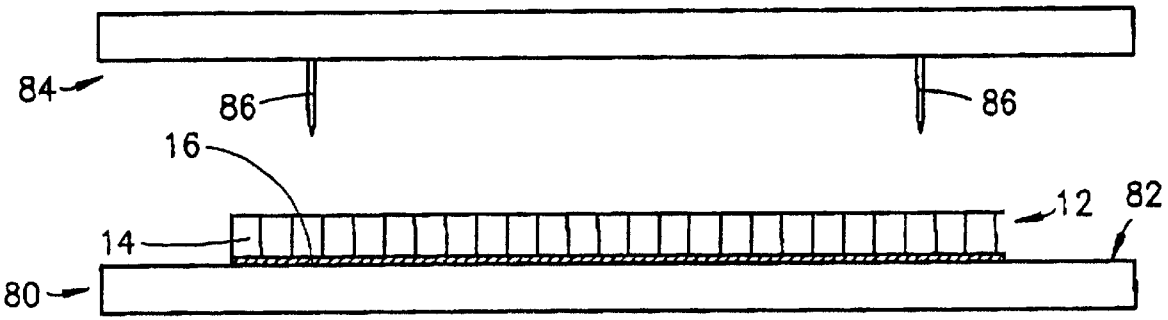

The method according to which the assembly of base panel 12 with the conductive foil element 20 thereon is made will now be described in more detail, with reference to FIGS. 8 to 10.

The base panel 12 (i.e. the substrate sheet 14 with the conductive foil layer 16 pre-applied thereto) is cut by means of a die-cutting apparatus comprising a base 80 with a flat upper surface 82, and a movable head 84 having cutter blades 86 mounted thereon. The base panel 12 is laid on the base 80 with the foil layer 16 being on the surface 82. The head 84 is then brought down, causing the cutter blades 86 to penetrate the base panel 12 first through the substrate sheet 14 and then through the foil layer 16. This ensures that a clean cut of the foil layer 16 is achieved.

Thereafter, by means of a silk-screening process, an adhesive 88 is applied to the upper face of the base panel 12, in an area where the feed circuit 22 and patches 24 of the foil element 20 are to be adhered to the base panel.

Before application of the conductive foil element 20 to the base panel 12, a protective peel-off sheet (not shown) may be applied to the base panel 12, to cover the adhesive 88. This will be desirable if the base panel, after application of the adhesive and before application of the conductive foil element 20, is to be stored or transported from one manufacturing facility to another.

Furthermore, a foil sheet 90 is die-cut along the outline 92 of what is to form the feed circuit 22 and the patches 24. There are nicks in the cutter blades of the die-cutting apparatus that is used for this purpose, so that bridge portions 94 remain, which. attach that part 96 of the foil sheet that is inside the outline 92 to that part 98 of the foil sheet that is outside the outline 92.

Immediately prior to application of the foil element 20 to the base panel 12, the peel-off sheet is removed from the base panel 12 so as to expose the adhesive 88, and the foil sheet 90 then applied to the base layer. This causes the part 96 of the foil sheet 90 to adhere to the base panel 12. Thereafter, the part 98 is removed by severing the bridge portions 94. It will be understood that the outline of the area across which the adhesive 88 is applied does not necessarily have to correspond exactly to the outline 92. It could be slightly inside or slightly outside the outline 92.

In an alternative method, instead of applying adhesive 88 in a selected area to the base panel 12, an adhesive layer covered by a peel-off sheet is laminated to the conductive foil sheet 90. The laminate is then die-cut along the outline 92, in a die-cutting apparatus which has nicks in the cutter blades thereof, to leave bridge portions 94. Thereafter, only that part of the peel-off sheet which is inside the outline 92 is removed, by severing the bridge portions 94 of the peel-off sheet, thereby to expose the adhesive in the areas of what is to form the feed circuit 22 and patches 24. The laminate is then applied to the base panel 12, so that that part of the foil sheet which is inside the outline 92 becomes adhered to the base panel. Thereafter, that part of the laminate (foil sheet and peel-off sheet) which is on the outside of the outline 92 is removed by severing the bridge portions 94.

What is claimed is:

1. An antenna which comprises a ground plane;

a conductive foil element spaced from the ground plane; and a dielectric substrate separating the conductive foil element from the ground plane, the dielectric substrate including a unitary sheet of integrally extruded plastics material having a pair of spaced parallel skins and webs extending between and separating the skins, and the webs having a cellular configuration in cross-section.

2. An antenna according to claim 1 and including one or more radiator elements, wherein the conductive foil element is configured to form a feed circuit for the radiator element or elements.

3. An antenna according to claim 2, wherein the feed circuit is a microstrip feed circuit.

4. An antenna according to claim 2, wherein the feed circuit is a stripline feed circuit.

5. An antenna according to claim 1 and including one or more radiator elements, wherein the conductive foil element is configured to form. said radiator element or elements.

6. An antenna according to claim 1, wherein the dielectric substrate comprises a pair of superimposed lower and upper sheets of dielectric material, each said sheet being of an extruded plastics material having a cellular configuration in cross-section, and the upper sheet having an edge which is within the periphery of the lower sheet, and wherein the conductive element is a one-piece element having a first portion which is supported by the upper face of the lower sheet, a second portion which extends up said edge to the upper face of the upper sheet, and a third portion which is supported by the upper face of the upper sheet.

7. An antenna according to claim 1 and including one or more radiator elements, wherein the conductive element is a one-piece element which is configured to form said radiator element or elements and a feed circuit for the radiator element or elements.

8. An antenna according to claim 7, wherein the dielectric substrate comprises a pair of superimposed lower and upper sheets of dielectric material, each said sheet being of an extruded plastics material having a cellular configuration in cross-section, and the upper sheet having an edge which is within the periphery of the lower sheet, wherein that part of said conductive element which forms the feed circuit has a first portion which is supported by the upper face of the lower sheet and a second portion which extends up said edge to the upper face of the upper sheet, and wherein that part of said conductive element which forms the radiator element or elements is supported by the upper face of the upper sheet.

9. An antenna according to claim 1, wherein the conductive foil element comprises a die-cut conductive foil element.

10. A method of making an antenna having a dielectric substrate and a conductive foil element on the substrate, the foil element having a predetermined outline, which method comprises:

providing the substrate as a sheet of extruded plastics material having a cellular configuration in cross-section;

providing a sheet of conductive foil and die-cutting the foil sheet along said outline, in such a manner that bridge portions of foil remain between that part of the foil sheet which is inside the outline and that part of the foil sheet which is outside the outline;

applying the foil sheet, after it has been die-cut, to the substrate sheet, there being an adhesive between that part of the foil sheet which is inside the outline and the substrate sheet, so that that part of the foil sheet which is inside the outline becomes attached to the substrate sheets by means of the adhesive; and thereafter removing that part of the foil sheet which is outside the outline by severing the bridge portions.

11. A method according to claim 10, wherein, prior to applying the foil sheet to the substrate sheet, the adhesive is applied to the substrate sheet across a selected area corresponding roughly to the area defined by said outline.

12. A method according to claim 11, wherein the adhesive is applied to the substrate sheet by means of a silk-screening process.

13. A method according to claim 11, wherein a protective peel-off sheet is applied to the substrate sheet after the adhesive has been applied to the substrate sheet, to cover the adhesive, and wherein the peel-off sheet is subsequently, prior to applying said foil sheet to the substrate sheet, removed.

* * * * *